US006698121B2

(12) United States Patent
Wardle et al.

(10) Patent No.: US 6,698,121 B2
(45) Date of Patent: Mar. 2, 2004

(54) DIGITAL DASHER BOARDS FOR SPORTS ARENAS

(75) Inventors: Rodney D. Wardle, Henderson, NV (US); Todd M. Stih, Lawrenceville, GA (US); John Williams, Las Vegas, NV (US); Kenneth Roostee, Las Vegas, NV (US); Graham Beland, Las Vegas, NV (US); Blake Gover, Las Vegas, NV (US); Todd W. Orme, Henderson, NV (US); Geoffrey W. Bickel, Henderson, NV (US); Laurence Kiyoshi Ishida, Las Vegas, NV (US)

(73) Assignee: Young Electric Sign Co., Las Vegas, NV (US)

( * ) Notice: Subject to any disclaimer, the term of this patent is extended or adjusted under 35 U.S.C. 154(b) by 68 days.

(21) Appl. No.: 09/849,475

(22) Filed: May 4, 2001

(65) Prior Publication Data

US 2002/0162256 A1 Nov. 7, 2002

(51) Int. Cl.[7] ..... G09F 3/04

(52) U.S. Cl. ..... 40/452; 40/550; 362/800; 362/812

(58) Field of Search ..... 40/452, 550, 442, 40/444, 581; 345/82, 83; 362/800, 812

(56) References Cited

U.S. PATENT DOCUMENTS 3,163,949 A * 1/1965 Gley ..... 40/452
3,595,991 A * 7/1971 Diller ..... 257/89
4,254,453 A * 3/1981 Mouyard et al. ..... 340/815.54
4,709,307 A * 11/1987 Branom ..... 362/103
4,962,419 A * 10/1990 Hibbard et al. ..... 348/253
4,970,812 A * 11/1990 Tanaka et al. ..... 40/444
5,025,351 A * 6/1991 Martin ..... 280/851
5,043,716 A * 8/1991 Latz et al. ..... 345/82
5,184,114 A * 2/1993 Brown ..... 345/600
5,575,098 A * 11/1996 Goettel-Schwartz ..... 362/151
5,656,847 A * 8/1997 Okazaki et al. ..... 257/100
5,887,968 A * 3/1999 Logan ..... 362/240
5,934,798 A * 8/1999 Roller et al. ..... 362/230
5,950,340 A * 9/1999 Woo ..... 362/235
6,154,945 A * 12/2000 Voelzke ..... 29/426.1
6,364,507 B1 * 4/2002 Yang ..... 362/240

* cited by examiner

*Primary Examiner*—William Miller
(74) *Attorney, Agent, or Firm*—TraskBritt

(57) ABSTRACT

A method and apparatus for integrating an illuminated sign system with a dasher board in a hockey rink. The illuminated sign system includes an outer frame with an impact resistant transparent sheet secured to a front surface of the outer frame. The sign system includes a display panel member having a white front surface and a plurality of apertures therein. The display panel member includes a circuit board assembly having a plurality of LED trios positioned proximate the rear surface of the display panel member so that LED trios register and protrude through a corresponding aperture in the display panel member. The illuminated sign system includes a power supply and a controller for controlling the power supplied to specific LEDs in each of the LED trios. In addition, the controller controls the intensity emitted by the LEDs to thereby manipulate the color contrast with the white front surface of the display panel member. The illuminated sign system also includes shock absorbers for absorbing the impact of hockey play to the outer frame and the transparent sheet.

27 Claims, 6 Drawing Sheets

DIGITAL DASHER BOARDS FOR SPORTS ARENAS

BACKGROUND OF THE INVENTION

1. Field of the Invention

The present invention relates generally to a sign system in a sports arena. More specifically, the present invention relates to an illuminated sign system integrated with a dasher board in a hockey rink.

2. State of the Art

Signs are widely used to display promotional or informational images to observers in areas where large numbers of observers may view them, such as along roads and highways. Signs are also often used in sporting events where the signs actually become a part of the arena or the enclosed boundary of an event. For example, the boundaries of a hockey rink not only serves as an advertising means with various types of sign systems, but also as a "dasher board" which takes the hockey player's abuse of bodychecks, hits from the skates, sticks and pucks.

A popular and inexpensive method to provide advertising in a sports arena, and specifically to the dasher board in a hockey rink, is by providing the print directly to the sign surface in a fixed form. Such fixed forms may include permanently painting the images on the dasher board or by providing already prepared vinyl images to be attached to the dasher board. However, providing images to the dasher board in a fixed form can become outdated, dull, stagnant, and ineffective from an advertising standpoint. Therefore, other methods of advertising are preferred.

Another very popular method of advertising in various types of sporting arenas is found in U.S. Pat. No. 5,233,772 (Bergeron et al.) and U.S. Pat. No. 5,255,463 (Werner), each disclosing a rotating sign system. Although this type of sign system provides images that are quickly and easily changeable, the images are static and are severely limited as to the number of different images that may be provided in the rotating sign system, generally no more than three. Further, the motor for the rotating sign system protrudes from the back of the sign system, which infringes on the seating room for the spectators seated immediately behind the sign system. Furthermore, the rotating sign systems typically must be operated manually and operated on location.

Another type of sign commonly used is an illuminated sign, which are currently used for providing both static and dynamic images with an infinite number of image displays. See, for example, U.S. Pat. No. 5,668,568 (Holloman). Light-emitting diodes (LEDs) assembled for such displays are disclosed in U.S. Pat. No. 5,410,328 (Yoksza, et al.), U.S. Pat. No. 5,174,649 (Alston) and U.S. Pat. No. 5,656,847 (Okazaki, et al.). The use of LEDs in controlled displays utilizing a trio of LEDs, e.g., a red, a blue and a green LED, to display a composite color of virtually any color in the spectrum is known and disclosed in U.S. Pat. No. 3,595,991 (Diller) and U.S. Pat. No. 5,184,114 (Brown). Such signs are provided by projecting a matrix of light emitting diodes, typically from a black sign surface. The LEDs are activated in different patterns to create one or more sequential images including images that may be likened to a continuous moving image. Significantly, the black sign surface is used so that the image projected by the LEDs provides the necessary contrast against the black sign surface to be clearly seen by viewers under most any lighting condition.

Such LED sign systems are typically used in various types of sporting arenas at elevated levels, where the sign system is not subjected to physical abuse, such as occurs with the dasher boards in a hockey rink. Further, LED sign systems are necessitated at elevated levels in a hockey rink since the system's black sign surface would severely limit visibility of the black hockey puck during hockey play.

While it would be advantageous to provide an illuminated sign system integrated with a dasher board in a hockey rink or other similar sporting and entertainment events, such a system does not currently exist.

BRIEF SUMMARY OF THE INVENTION

The present invention relates to an illuminated sign system in a sports arena such as a hockey rink. The present invention is directed to an illuminated sign system integrated with a dasher board in a hockey rink.

The sign system includes a display panel member having a plurality of apertures therein and an outer frame support for supporting the display panel member. The outer frame is rectangular in shape and protrudes away from the front surface of the display panel member. The outer frame support also supports a tough, rigid transparent sheet on the front surface of the outer frame support. The sign system also includes a circuit board assembly having a plurality of light-emitting diodes ("LEDs") attached thereto and extending therefrom, wherein the plurality of LEDs are formed in a matrix of vertical columns and horizontal rows. The circuit board assembly is proximately positioned at a rear surface of the display panel member so that the plurality of LEDs register with the plurality of display panel apertures and extend therethrough.

The display panel member includes a white front surface and a rear surface with the plurality of apertures penetrating through the display panel member therein. The plurality of apertures are configured in rows and columns in the display panel member to define a matrix of apertures, wherein each aperture is configured to accept a single LED or a clustered trio of LEDs from the circuit board assembly. The white front surface of the display panel member is provided for visual contrast with black hockey pucks in hockey play.

The outer frame support is made to rigidly support the transparent sheet so that the transparent sheet overlaps the front surface of the outer frame support. The transparent sheet in connection with the outer frame support acts as the dasher board and boundary of an ice rink, and specifically, a hockey rink. As such, the transparent sheet in connection with the outer frame support will receive the direct impact hits associated with hockey play. The transparent sheet is therefore a transparent polymer of approximately a half inch thick and made to be substantially impact resistant.

The circuit board assembly includes printed circuitry on at least one surface thereof and receptacles for the plurality of LEDs. Each receptacle is configured to receive an LED trio or a clustered trio of LEDs. Each LED trio includes a red LED, a green LED and a blue LED. Each LED trio may alternately be referred to as a pixel. By this arrangement, when the circuit board assembly is in a proximate position to the rear surface of the display panel member, each LED trio is made to register and protrude through a corresponding aperture in the display panel member, thereby, providing a matrix of pixels extending through the matrix of apertures.

In one aspect of the present invention, the circuit board assembly includes a power supply and a controller for controlling the power supply to each of the LEDs in the LED trio. As such, the controller controls the images displayed by the LEDs by controlling which LEDs in the matrix of pixels emit visual light.

In one embodiment of the present invention, LEDs not needed for a particular image are prevented or controlled from emitting light. In another embodiment, LEDs not needed for a particular image are made to emit white light, thereby increasing the contrast of the particular image against the white front surface of the panel member. In still another embodiment, a gamma characteristic or luminance is adjustable in those energized LEDs emitting light to increase the intensity and, thereby, the contrast of the visual light against the white front surface of the panel member.

In another preferred aspect of the present invention, the circuit board assembly includes a plurality of circuit boards, wherein each circuit board includes a matrix of LED lamps corresponding to receptacles on each circuit board. The plurality of circuit boards are made to abut side-to-side and top-to-bottom so that each of the LED lamps register and protrude through corresponding apertures in the display panel member. Each of the LED lamps on each of the circuit boards are spaced such that when the plurality of circuit boards are made to register with corresponding apertures in the display panel, there is provided substantially evenly spaced LED lamps forming a continuous matrix.

In a preferred embodiment, the outer frame support is elongated, requiring multiple display panel members abutting side-to-side to form a complete single and uniform digital dasher board display. As such, the apertures formed therein are spaced such that the apertures are substantially evenly spaced from one display panel to another to form a substantially continuous matrix of apertures.

In another aspect of the present invention, the illuminated sign system includes at least one shock absorber to absorb impact shocks imposed on the outer frame support and the transparent sheet from being transferred to the display panel and circuit boards. Such shock absorber is thus positioned between the outer frame support and the display panel member to protect the display panel member and said circuit board assembly from the impacts received to the transparent sheet and outer frame support.

In one embodiment, the at least one shock absorber includes a rigid member extending through a resilient member. The rigid member is made for bolting to the outer frame support and being secured to the display panel member. The resilient member is made for absorbing the impacts to the transparent sheet to therefore prevent jarring and potentially damaging the display panel member and the circuit board assembly.

Other features and advantages of the present invention will become apparent to those of skill in the art through a consideration of the ensuing description, the accompanying drawings, and the appended claims.

BRIEF DESCRIPTION OF THE SEVERAL VIEWS OF THE DRAWINGS

While the specification concludes with claims particularly pointing out and distinctly claiming that which is regarded as the present invention, the advantages of this invention may be ascertained from the following description of the invention when read in conjunction with the accompanying drawings, in which:

DETAILED DESCRIPTION OF THE INVENTION

Preferred embodiments of the present invention will be hereinafter described with reference to the accompanying drawings. It should be understood that the illustrations are not meant to be actual views of any particular apparatus and/or method, but are merely idealized representations which are employed to more clearly and fully depict the present invention than would otherwise be possible. Additionally, elements and features common between the figures retain the same numerical designation.

Figure 1:
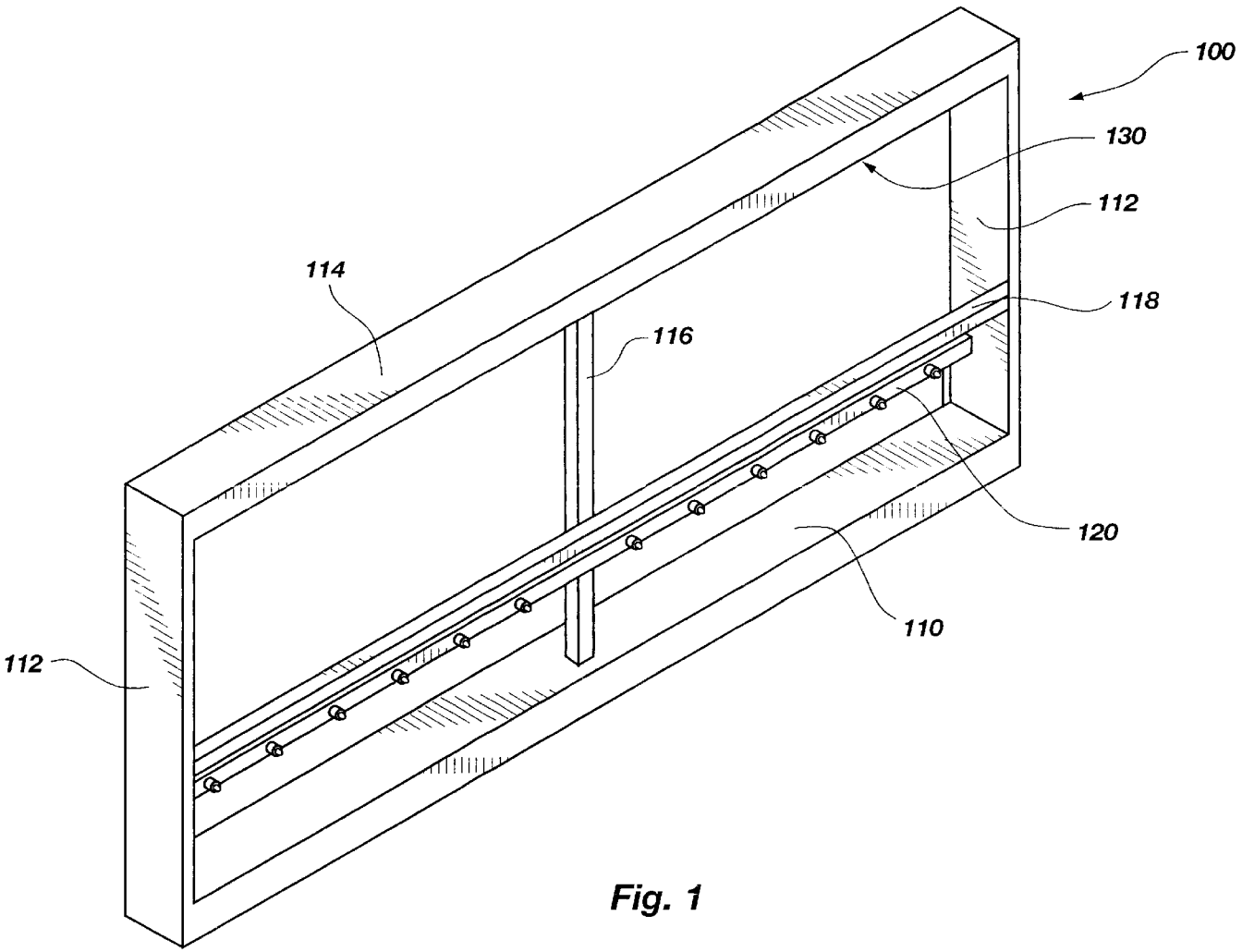
FIG. 1 is a simplified perspective view of an outer frame of the digital dasher board according to the present invention.

An exemplary embodiment of a method and apparatus incorporating teachings of a sign system is shown in FIGS. 1 through 9. FIG. 1 depicts a simplified perspective view of dasher board frame 100. The dasher board frame 100 includes a frame base 110 and outer frame sides 112 on the right and left side thereof, and an outer frame top 114 extending from the right and left side of the outer frame sides 112. The dasher board frame 100 also includes one or more vertical supports 116 extending from the frame base 110 to the outer frame top 114 at a back portion of the dasher board frame 100. There is also a middle support 118 extending between the right and left sides of the outer frame sides 112. The dasher board frame 100 is preferably made of a high-grade steel, wherein each of the above-discussed portions are rigidly connected to make the whole of the dasher board frame 100. However, the dasher board frame 100 may be made of any suitable material as known in the art. With this arrangement, the dasher board frame 100 may be about eight feet in length and about thirty-six inches high, however, dasher board frame 100 may extend at any length by simply adding vertical supports 116 at appropriate spacings. Further, multiple dasher board frame 100 may abut side-to-side to visually appear as one dasher board frame 100.

According to the present invention, FIG. 1 depicts the dasher board frame 100 to include a lower sign support 120 and an upper sign support 130. The lower support 120 may extend from the right and left outer frame sides 112 at about nine to twelve inches above the frame base 110, wherein the lower support 120 includes a front surface 124 and a back surface 126. The upper sign support 130 may extend from the right and left sides of the outer frame sides 112 at an upper portion adjacent to the outer frame top 114, wherein the upper sign support 130 includes a front surface 134 and a back surface 136. The lower sign support 120 and the upper sign support 130 may be proximate a front side of the dasher board frame 100, wherein the middle support 118 and the vertical support 116 are proximate a backside of the dasher board frame 100 in a recessed manner.

Figure 2:
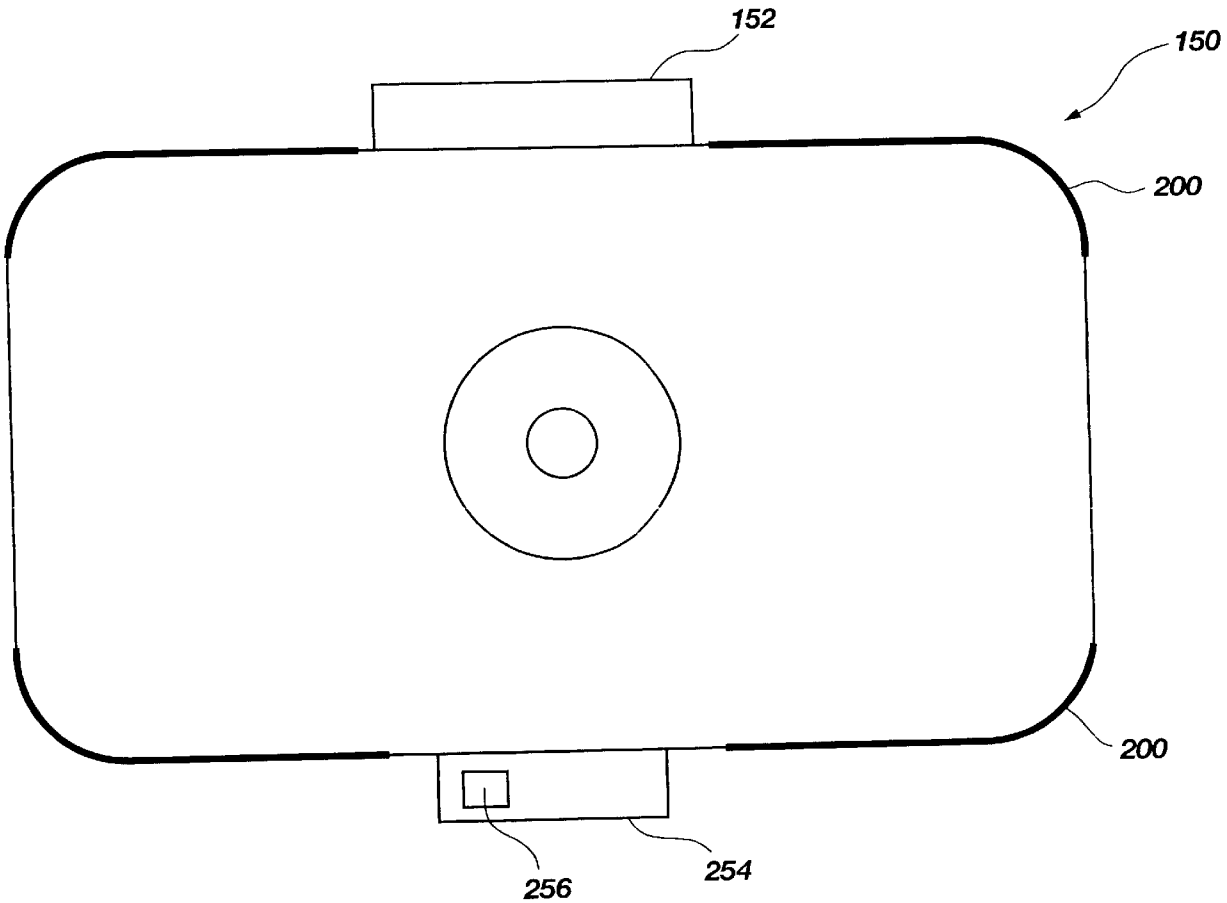
FIG. 2 is a simplified top view of an ice rink having the digital dasher board according to the present invention.

The dasher board frame 100 is configured to house a sign system, namely, a dynamic display system such as a digital dasher board 200. As shown in FIG. 2, the digital dasher board 200 will be provided as a portion of the boundary or periphery of an ice rink in an arena, such as a sports arena having team boxes 152 and camera boxes 154. Due to the length of the periphery, the digital dasher board 200 may be elongated or include multiple digital dasher boards 200 abutting side-to-side as previously set forth for the dasher board frame 100. In this manner, the digital dasher board 200 is a predetermined length around one or more portions of the periphery of the ice rink 150 so that it may be segmented from portions of the periphery such as the team boxes 152 and camera boxes 154. Thus, from a viewers point of view, the dynamic display system presents a uniform continuous image display. Further, FIG. 2 depicts the ice rink 150 to include the remote computer 156 located in the camera boxes 154, where a remote computer 156 may act as a controller 280 (see FIG. 5) for the digital dasher board 200. The computer 156 may be located at any remote location.

Figure 3:
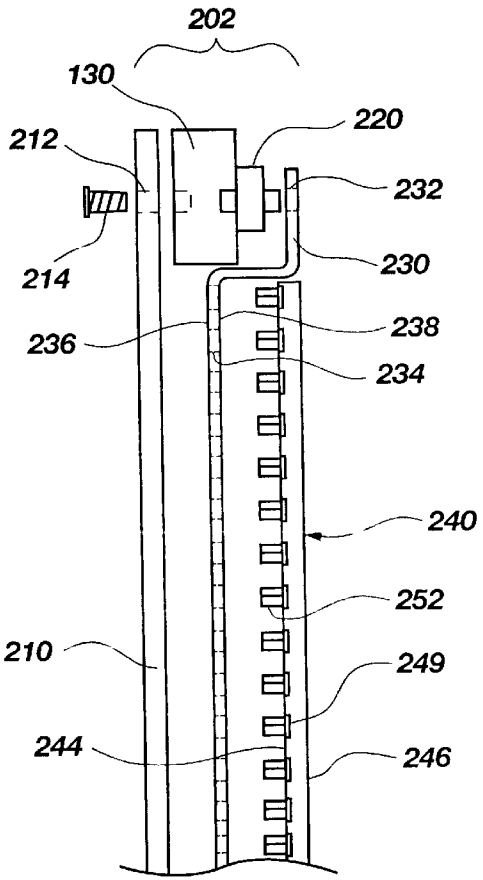
FIG. 3 is a partial simplified cross-sectional side view of the upper sign face area according to the present invention.
Figure 4:
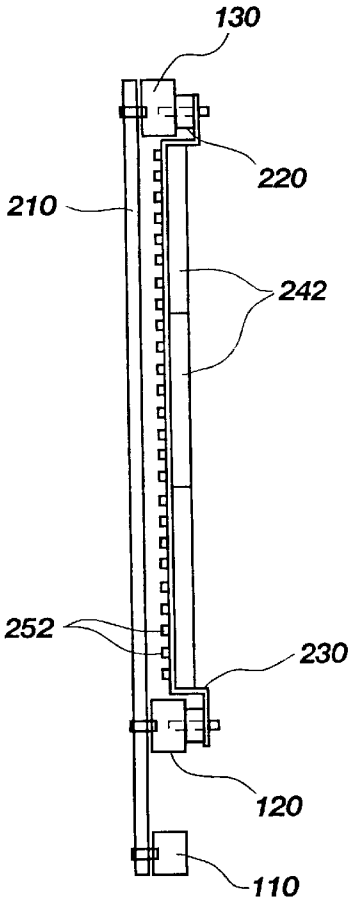
FIG. 4 is a simplified cross-sectional side view of the sign face area according to the present invention.
Figure 5:
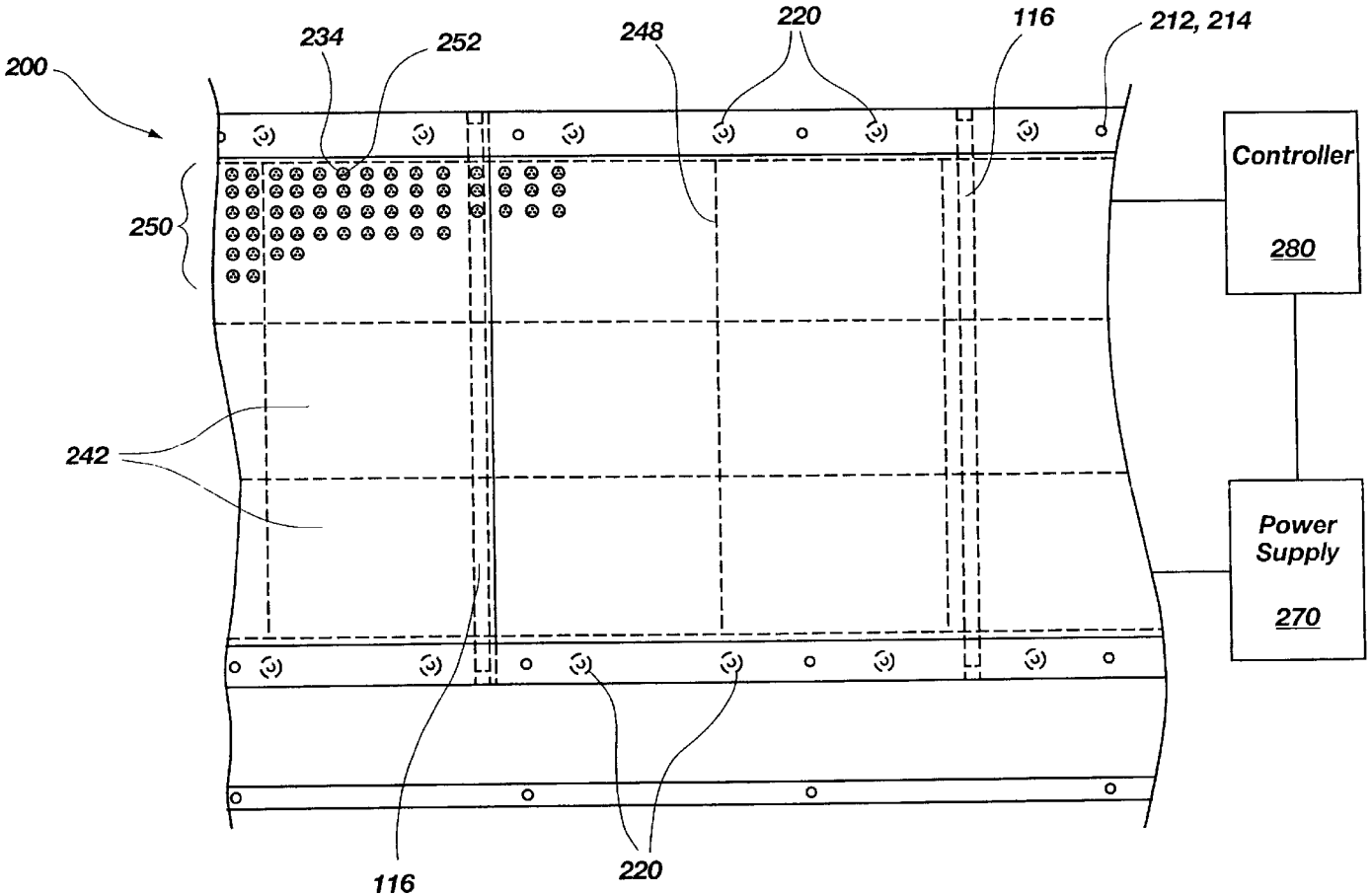
FIG. 5 is a partial simplified front view of the digital dasher board and a simplified block diagram of a power supply and a controller according to the present invention.

Reference will now be made to FIGS. 3 through 5 in describing the sign face system 202 of the digital dasher board 200. As shown in FIGS. 3 and 4, the lower sign support 120 and upper sign support 130 are made for supporting the sign face system 202. In particular, a transparent sheet is provided for attaching to a front surface of the upper sign support 130 and a front surface of the lower sign support 120 by openings 212 spaced across and upper portion and a lower portion of the transparent sheet 210. The openings 212 are made to correspond with openings in the lower and upper sign supports 120 and 130 so that bolts 214 or some other attaching means may be used for attaching the transparent sheet 210 to the respective front surfaces 124, 134 of the lower and upper sign supports 120 and 130. The transparent sheet 210 is preferably about ½ inch thick and is made of either plexiglass or lexan glass. However, the transparent sheet 210 may also be made of other adequately durable transparent materials. Further, the transparent sheet 210 may include an anti-reflective coating on a front surface and/or a back surface of the transparent sheet. Such anti-reflective coating will substantially eliminate or reduce potential glare to a viewer produced from external lighting in the arena and internal lighting of the digital dasher board 200. The transparent sheet 210 may be attached by any means to the upper and lower support system such as by adhesive, clips, clamps or the like.

Figure 6:
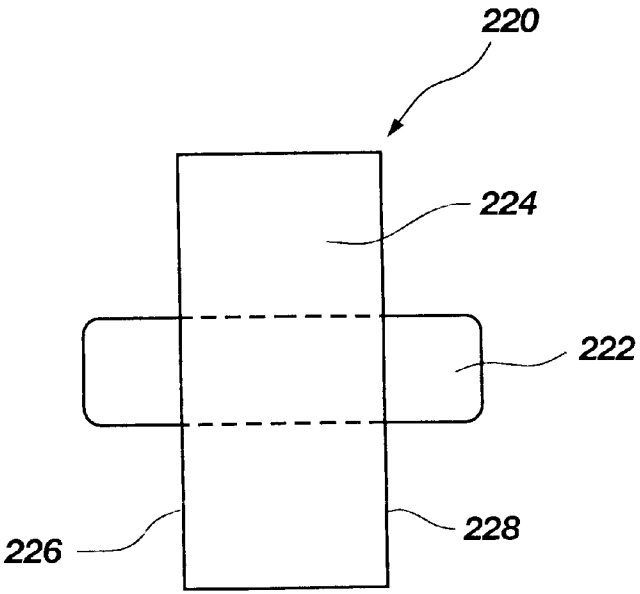
FIG. 6 is a simplified cross-sectional side view of the shock absorber according to the present invention.

At the respective back surfaces 126, 136 of the lower and upper sign supports 120 and 130 there is included a plurality of shock absorbers 220. As depicted in FIG. 6, each shock absorber 220 includes a resilient member 224 and bolt 222. The bolt 222 extends through a middle portion of the resilient member 224 so that the bolt 222 projects from a front face 226 of the resilient member 224 and a back face 228 of the resilient member 224. In this manner, the bolt 222 projecting from the front face 226 of the resilient member 224 may be attached or bolted to the respective back surfaces 126 and 136 of the lower and upper sign supports 120 and 130. Preferably, the shock absorbers 220 are rigidly mounted to the lower and upper sign supports 120 and 130. The resilient member 224 is preferably made from a shock absorbing rubber, but may be made from any known material known for its shock absorbing characteristics. Further, any known shock absorbing means may be used as known to one of ordinary skill in the art.

Figure 7:
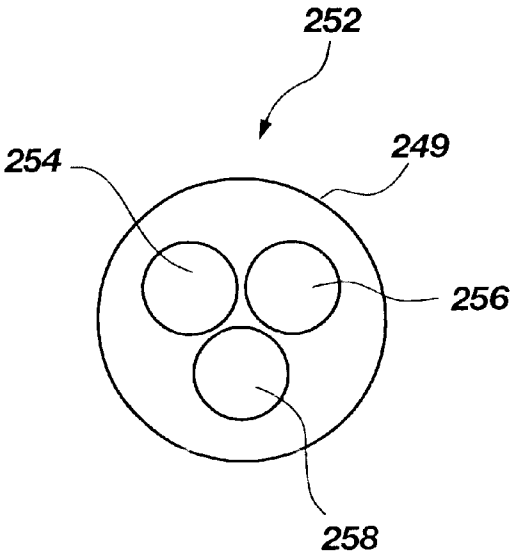
FIG. 7 is a simplified front view of the LED's according to the present invention.

According to the present invention, a display panel 230 is made to attach to the plurality of shock absorbers 220. As shown in FIG. 7, the display panel 230 includes a plurality of attachment openings 232 therein, which correspond at predetermined spacings with the bolt extending from the back face 228 of the plurality of shock absorbers 220 as attached to the upper and lower sign supports 130 and 120. The display panel 230 also includes a plurality of apertures 234 therein configured in columns and rows over the display panel 230 to provide a matrix. Each of the plurality of apertures 234 in columns and rows are spaced at a substantially equal distance from each other. By this arrangement, the attachment openings 232 may be securely attached to each of the bolts extending from the back face of the shock absorbers 220 so that there is a space between the transparent sheet 210 and the display panel 230. See FIGS. 3 and 4. Such space is preferably in the range of about ⅜ inch to about 2 inches and, more preferably, the space is in the range of about ⅜ inch to about 1 inch. However, such space may be any range suitable to practice the present invention.

The display panel 230 includes a white front face 236 and a rear face 238. Each aperture of the plurality of apertures 234 extends through the display panel 230 from a rear face 238 to the front face 236. The apertures 234 are shown to be circular in cross-section. However, the display panel 230 may have apertures of different shapes such as elliptic, triangular, rectangular and/or the like. Any geometric shape may be used so long as the opening has sufficient cross-section to allow light-emitting diodes ("LEDs") to protrude therethrough (see FIG. 4), as will be discussed in further detail hereafter. The apertures 234 with the circular cross-section is preferred since it is easiest to form by simply drilling through the display 230.

As shown in FIGS. 3–5, a circuit board assembly 240 includes a matrix or a plurality of LEDs 250 which are configured to correspond and register with the matrix or the plurality of apertures 234 in the display panel 230. The circuit board assembly 240 includes a plurality of rectangular circuit boards 242, each of which includes a front face 244, a back face 246 and sides 248 which make up the periphery of each circuit board 242.

The circuit boards 242 include printed circuitry on the front face 244 and/or the back face 246 and/or embedded therein. The printed circuitry includes imbedded conductors and attached electrical components all configured to deliver power to each of the LEDs mounted to receptacles 249 on the front face 244 of each circuit board 242. In particular, the receptacles 249 are each mounted in rows and columns on the front face 244 to form a matrix of receptacles 249. Further, each of the receptacles 249 include an LED trio 252 clustered in close proximity to each other to form a pixel, thereby forming the matrix or plurality of LEDs 250. By this arrangement, FIG. 4 illustrates that when the circuit board assembly 240 is attached to the rear surface 238 of the display panel 230, the matrix of LEDs 250 extending from the circuit board assembly 240 registers and protrudes through corresponding apertures 234 in the display panel 230. As such, each LED trio 252 preferably extends about one fourth inch beyond the front face of the display panel 230. However, each LED trio 252 may sit extended, flush, or recessed at any appropriate distance with respect to the front face 236 of the display panel 230 so that the necessary light emits therefrom.

As shown in FIG. 7, each LED trio 252 or pixel is a cluster of LEDs, each of which register with the receptacle 249 and the front face 244 of the circuit board 240. Each LED trio 252 includes a red LED 254, a blue LED 256 and a green LED 258. Note that the triangular clustered configuration as depicted in FIG. 7 is preferred, but such configuration is not necessary. Each of the LEDs in a trio registers with the receptacle 249 for electrical connection to the circuit board 242 and the circuitry therein. In this manner, each LED in the LED trios 252 may be energized independently as desired.

As shown in block diagram in FIG. 5, the digital dasher board 200 includes a power supply 270 and a controller 280. The power supply provides power to the digital dasher board 200 and, more specifically, to the circuit board assembly 240 as well as the controller 280. The power delivered is preferably from an external source and may differ from one location to another. Thus, a highly regulated and flexible power supply 270 is preferred to facilitate power use independent of the characteristics of the power being supplied (e.g., voltage, current, power, frequency).

The controller 280 functions to control the circuit board assembly 240 and specifically, the plurality of LEDs 250 mounted thereto. The controller 280 comprises the computer 156 (see FIG. 2) and is configured to provide input and output signals to the digital dasher board 200 from a control interface at a remote location. The controller 280 is programmable and operable to select and activate selected LEDs in the matrix of LEDs 250, and more specifically, selected LEDs in each of the LED trios 252. As such, the controller 280, via the power supply 270, selects and illuminates particular LEDs to collectively provide images displayed from the digital dasher board 200.

As shown by dashed lines in FIG. 5, the sign face system 202 comprises attaching a plurality of the circuit boards 242 to the back face of the display panel 230. As such, the circuit board assembly 240 includes multiple circuit boards 242 abutting from side-to-side and top-to-bottom to form columns and rows of circuit boards 242 to be attached to the rear face 238 of the display panel 230. According to the present invention, the LED trios and receptacles 249 on each of the circuit boards 242 are spaced equally such that any circuit board 242 abutting next to another circuit board 242, provides LEDs 252 spaced equally from one circuit board 242 to another. Further, the display panel having the matrix of apertures may include multiple display panels 230 to abut side to side so that the apertures 234 therein are equally spaced from one display panel 230 to another display panel 230.

Figure 8:
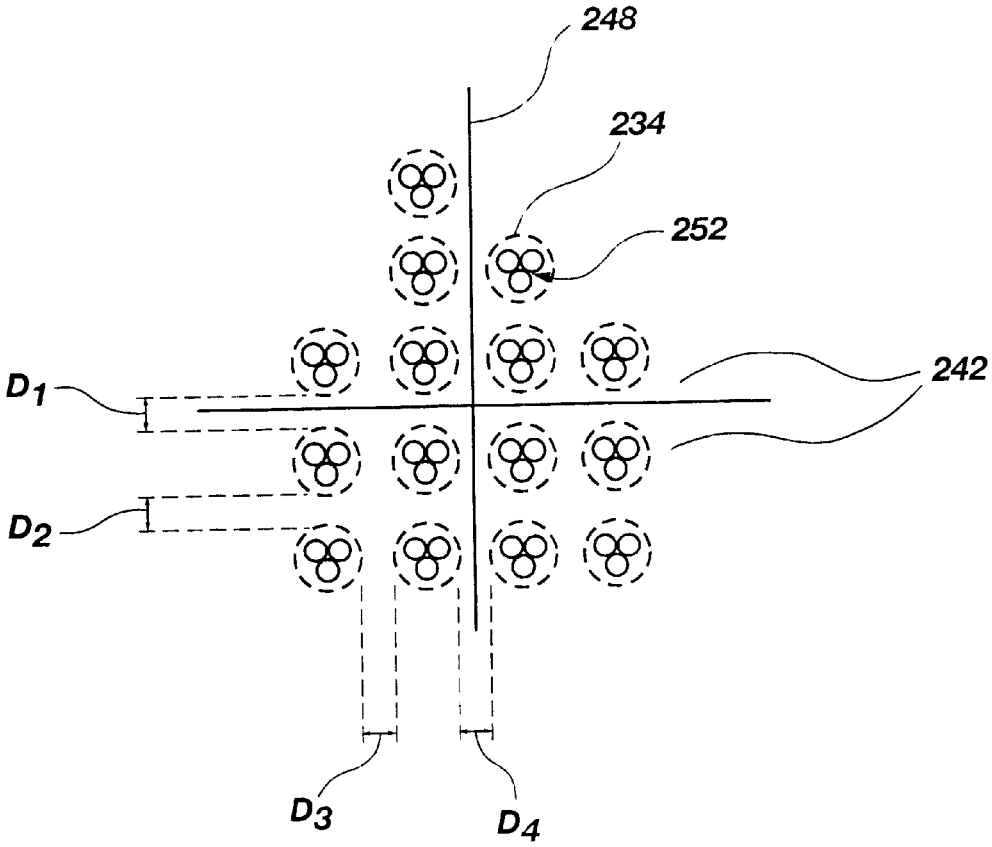
FIG. 8 is a partial simplified front view of circuit board corner portions according to the present invention.

Such equal spacing of LED trios 252 between adjacent circuit boards 242 and/or apertures 234 between adjacent display panels 230 is illustrated in FIG. 8. As shown, the distance $D_1$ is substantially equal to the distance $D_2$ which in turn is substantially equal to the distance $D_3$ and the distance $D_4$ between columns and rows of LED trios 252 from circuit board 242 to circuit board 242 and/or apertures 234 between adjacent display panels 230 respectively. In this manner, the LED trios 252 provide substantially uniform images without interruption between adjacent circuit boards 242, adjacent display panels 230, and even adjacent digital dasher boards 200. Thus, a substantially continuous and uniform display of images may be provided on the digital dasher board 200 about periphery portions of the ice rink 150 (see FIGS. 2 and 5).

According to the present invention, the primary reason for using "white" for the white front face 236 of the display panel 230 is to provide visual contrast with the black hockey puck, as opposed to the black background of the conventional LED display. The present invention offers the operator the ability to illuminate only the LEDs 250 that comprise an advertisers particular image, leaving the unnecessary LEDs 250 in the off position. By doing this, the viewer will see the image projected by the illuminated LEDs having a white background from the white front face 236 of the display panel 230.

Alternatively, each of the LED trios 252 not needed for a particular image, may also be substantially illuminated the color white. The white illumination is employed by controlling the illumination of an LED trio 252, i.e., red, blue and green LEDs, in a manner that collectively emits each respective color to emit a white light. The white illumination in addition to the "whiteness" of the white front face 236 has increased contrast with the color images illuminated. This option may be preferred in certain lighting conditions for adding to the contrast of certain colors and/or shades of color against the white background.

In addition, each of the illuminated LEDs 250, i.e., red, blue and green, used to project a particular image, may be controlled by manipulating their "intensity" in order to increase the contrast between the desired image and the white background. The intensity is manipulated to correct a gamma characteristic. Gamma is the luminance of each color in a display (red, blue, green). Gamma correction controls or corrects the overall brightness of an image, where images not properly corrected can look either bleached out, or too dark. Such principles of gamma correction as applied in the present invention are readily known or may be readily ascertained by one of ordinary skill in the art. Further, the parameters necessary for applying the principles of gamma correction as applied in the present invention may be readily ascertained by one of ordinary skill in the art. For example, U.S. Pat. Nos. 4,962,419 (Hibbard et al.), 5,208,661 (Jaspers), 5,949,496 (Kim) and 5,874,988 (Gu) each disclose methods of gamma and color correction in various applications, of which each disclosure is incorporated herein.

In gamma correction, each color has its own "gamma curve", of which the luminance may be adjusted or manipulated on this gamma curve via software to brighten or darken each color individually. Essentially, adjusting the "gamma" or "intensity" is accomplished by adjusting the current and/or voltage (by a predetermined factor) that is provided to each of the LEDs 250, i.e., red, blue and green. Also, the intensity may be adjusted by receiving an eight-bit video signal and mapping the video signal to a twelve-bit video signal or gamma curve to enhance and control the intensity of the colors illuminated by the LEDs 250 and, thus, the images projected therefrom.

In order to compensate for variables such as different lighting conditions and inherent variables in an LED sign system itself, the gamma correction is adjustable and allows for such compensations to, thereby, provide the greatest contrast between the projected images and the white front face 236. With this in mind, it is important to realize that the human eye has a non-linear perceptual response to light and color, making the adjusting of the gamma luminance possible. The color we see in light depends on the colors wavelength (measured in nanometers), the luminance of the particular color, the area illuminated around the color, what the observer looks at prior to looking at the display and whether or not the image is moving or stationary are each factors having an effect on how we perceive the illuminated image.

According to an aspect of the present invention, YESCO's software can increase gamma (luminance) by a nominal percentage of, for example, about 20% and give the appearance of being about 50% brighter. When used for the digital dasher board 200, the gamma or intensity may be adjusted so that a particular image appears brighter than it really is and, therefore, enable the image to standout over the white front face 236 of the display without having to illuminate any LEDs in the background. In essence, the images projected by the LEDs 250 are brighter and clearer to the human eye by manipulating the gamma or intensity, thereby, substantially preventing washed out images. Therefore, while the conventional LED displays use a black background to add contrast to the illuminated LEDs, the present invention provides LEDs 250 using a white background, wherein manipulation of the gamma or intensity is used to assist in adding contrast.

While the present invention has been disclosed in terms of exemplary embodiments and variations thereof, those of ordinary skill in the art will recognize and appreciate that the invention is not so limited. Those of ordinary skill in the art will recognize and appreciate that many additions, deletions, and modifications to the disclosed embodiment and its variations may be implemented without departing from the scope of the invention, which is limited only by the appended claims and their legal equivalents.

What is claimed is:

1. An LED illuminated hockey rink dasher board display assembly comprising:

a thin display panel member having a white front surface and a rear surface, said panel member having a plurality of spaced apertures in a matrix configuration therein to accommodate LEDs;

an outer frame support for said panel member, said frame being rectangular in shape and protruding away from the front surface of said panel member;

a rigid transparent sheet contiguous with a front surface of said outer frame; wherein said panel member, said outer frame support and said rigid transparent sheet are sized and structured to function as a hockey-rink dasher board, and a circuit board assembly having printed circuitry on at least one surface thereof and LED receptacles for said LEDs, said LED receptacles numbered and grouped in a matrix configuration to be at the same spacing as the apertures in said panel member so that said LEDs provided in said receptacles are in register and protrude through said panel member apertures whenever said circuit board is in a proximate position to said rear surface of said panel member, said LEDs being sufficient in number in said matrix configuration to provide an illuminated display.

2. The assembly of claim 1, wherein said LEDs comprise a plurality of LED trios individually grouped as trio clusters, wherein said trio clusters are arranged in a matrix.

3. The assembly of claim 2, wherein each of said LED trios comprises a red LED, a green LED and a blue LED.

4. The assembly of claim 2, wherein each LED trio collectively comprises a white light source.

5. The assembly of claim 2, wherein said plurality of LED trios are spaced vertically and horizontally to form a matrix of pixels.

6. The assembly of claim 1, further comprising a power supply and a controller configured to control said power supply to said LEDs.

7. The assembly of claim 6, wherein said controller is configured to control said LEDs in at least one of an on position and an off position so that said LEDs collectively emit a predetermined image.

8. The assembly of claim 7, wherein said LEDs comprise a plurality of LED trios, wherein said LED trios not needed for said predetermined image each emit white light.

9. The assembly of claim 6, wherein said controller is configured to control said LEDs required to collectively emit a predetermined image comprising red light, green light and blue light and wherein said controller is configured to control an illuminated intensity emitted from each of said LEDs.

10. The assembly of claim 9, wherein said controller is configured to provide contrast between said predetermined image and said white front surface of said panel member by adjusting said illuminated intensity.

11. The assembly of claim 1, wherein said outer frame includes a separate sub-frame for supporting said thin display panel member and said circuit board assembly.

12. The assembly of claim 11, wherein said sub-frame comprises an upper panel member support and a lower panel support.

13. The assembly of claim 1, wherein said outer frame support comprises at least one shock absorber for absorbing impact to said outer frame support and said transparent sheet.

14. The assembly of claim 13, wherein said at least one shock absorber is positioned between said outer frame support and said panel member to substantially protect said panel member and said circuit board assembly from impact vibration.

15. The assembly of claim 13, wherein said at least one shock absorber comprises at least one of a resilient member and a rigid member.

16. The assembly of claim 15, wherein said resilient member comprises rubber.

17. The assembly of claim 1, wherein said transparent sheet is substantially impact resistant.

18. The assembly of claim 1, wherein said transparent sheet is spaced from said panel member a distance greater than the length of said LEDs protruding through said apertures of said panel member.

19. The assembly of claim 1, wherein said circuit board assembly includes a plurality of circuit boards, wherein each circuit board edge abuts with at least another circuit board edge when in said proximate position of said rear surface of said panel member.

20. The assembly of claim 19, wherein said LED receptacles in each of said plurality of circuit boards are each substantially equally spaced a uniform distance in rows and columns.

21. The assembly of claim 20, wherein a distance from a corner receptacle of one circuit board to an adjacent corner receptacle of an abutting adjacent second circuit board is substantially equal to said uniform distance.

22. The assembly of claim 1, wherein said panel member comprises a plurality of panel members, wherein each panel member abuts end to end to form a continuous matrix display of said LEDs protruding through said apertures of each panel member, wherein said LEDs are spaced a distance substantially uniform from one another over said continuous matrix display formed from said plurality of panel members.

23. A method of manufacturing a digital dasher board display, the method comprising:

providing an outer frame support having a rectangular shape said frame support sized and structured to be the size of a hockey rink dasher board;

providing a rigid transparent sheet to be contiguous with a front surface of said outer frame;

forming a thin display panel member with a plurality of apertures therein and having a white front surface and a rear surface, configuring said plurality of apertures to accommodate LEDs and spacing said plurality of apertures in horizontal rows and vertical columns to form a matrix;

supporting said panel member on said outer frame support with at least one shock absorber therebetween;

forming a circuit board assembly having receptacles for said LEDs on a front side thereof and spacing said receptacles to correspond with said apertures in said panel member; and securing said circuit board assembly on said rear surface of said panel member so that said LEDs register and protrude through said apertures of said panel member.

24. A method of increasing visibility of a dynamic image display system, the method comprising:

providing a thin display panel member having a white front surface and a plurality of apertures therein, configuring said plurality of apertures to accommodate LEDs and spacing said plurality of apertures in horizontal rows and vertical columns to form a matrix;

forming a circuit board assembly having receptacles for said LEDs on a front side thereof and spacing said receptacles to correspond with said apertures in said panel member;

securing said circuit board assembly on a rear surface of said panel member so that said LEDs register and protrude through said apertures of said panel member; and illuminating said LEDs with a power source and a controller; and controlling an intensity illuminated from said LEDs.

25. The method of claim 24, wherein said controlling comprises controlling visual contrast between said illuminated LEDs and said white front surface by gamma correction of said LEDs.

26. The method of claim 24, wherein said controlling comprises increasing said intensity illuminated from said LEDs.

27. The method of claim 24, wherein said controlling comprises adjusting said intensity illuminated from said LEDs to visually contrast with said white front surface.

* * * * *

UNITED STATES PATENT AND TRADEMARK OFFICE

CERTIFICATE OF CORRECTION

PATENT NO. : 6,698,121 B2
DATED : March 2, 2004
INVENTOR(S) : Rodney D. Wardle et al.

It is certified that error appears in the above-identified patent and that said Letters Patent is hereby corrected as shown below:

Drawings,
FIG. 2, change reference numeral "254" to -- 154 -- and change reference numeral "256" to -- 156 --

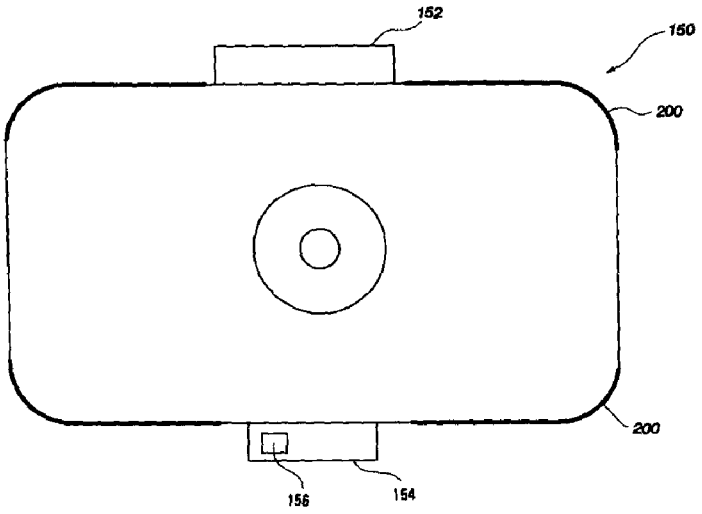

*Fig. 2*

Column 5,
Line 1, after "ice rink" insert -- 150 --
Line 41, after "upper and lower support system" insert -- 130 and 120 --

Column 7,
Line 30, after "LED trios" insert -- 252 --
Line 33, change "LEDs 252" to -- LED trios 252 --
Line 66, after "illuminated" insert -- by --

UNITED STATES PATENT AND TRADEMARK OFFICE

CERTIFICATE OF CORRECTION

PATENT NO. : 6,698,121 B2
DATED : March 2, 2004
INVENTOR(S) : Rodney D. Wardle et al.

It is certified that error appears in the above-identified patent and that said Letters Patent is hereby corrected as shown below:

Column 8,
Line 2, after “red” insert -- 254 --; after “blue” insert -- 256 --
Line 3, after “green” insert -- 258 --

Signed and Sealed this

Fifteenth Day of February, 2005

JON W. DUDAS
*Director of the United States Patent and Trademark Office*